US005537976A

United States Patent [19]

Hu

[11] Patent Number: 5,537,976

[45] Date of Patent: Jul. 23, 1996

[54] FOUR-CYCLE INTERNAL COMBUSTION ENGINES WITH TWO-CYCLE COMPRESSION RELEASE BRAKING

[75] Inventor: Haoran Hu, Farmington, Conn.

[73] Assignee: Diesel Engine Retarders, Inc., Wilmington, Del.

[21] Appl. No.: 512,540

[22] Filed: Aug. 8, 1995

[51] Int. Cl.[6] ..... F01L 13/06

[52] U.S. Cl. ..... 123/322; 123/90.12

[58] Field of Search ..... 123/321, 322, 123/90.12, 90.13, 90.11, 90.16, 21

[56] References Cited

U.S. PATENT DOCUMENTS

| | | | |
|---|---|---|---|
| 2,802,460 | 8/1957 | Shirley | 123/90.12 |
| 3,220,392 | 11/1965 | Cummins | 123/321 |
| 3,809,033 | 5/1974 | Cartledge | 123/90.46 |
| 4,572,114 | 2/1986 | Sickler | 123/21 |
| 4,664,070 | 5/1987 | Meistrick et al. | 123/21 |
| 4,741,307 | 5/1988 | Meneely | 123/321 |
| 4,957,075 | 9/1990 | Hasegawa | 123/90.12 |
| 5,113,812 | 5/1992 | Rembold et al. | 123/90.12 |
| 5,146,890 | 9/1992 | Gobert et al. | 123/321 |
| 5,255,641 | 10/1993 | Schechter | 123/90.11 |
| 5,325,825 | 7/1994 | Schmidt et al. | 123/90.39 |
| 5,379,737 | 1/1995 | Hu | 123/322 |

*Primary Examiner*—Andrew M. Dolinar
*Attorney, Agent, or Firm*—Fish & Neave; Robert R. Jackson

[57] ABSTRACT

An internal combustion engine has engine cylinder intake and exhaust valves that are operated by intake and exhaust cams via hydraulic linkages. The hydraulic linkages have selective lost motions that allow selective modification of the openings and closings of the engine cylinder valves. These modifications may include complete omission of all response to particular lobes on the cams. The hydraulic linkages may be interconnected so that some intake valve openings are produced by an exhaust cam lobe and/or some exhaust valve openings are produced by an intake cam lobe. The linkages and linkage interconnections are preferably controlled electronically. The engine is preferably operable in either four-cycle positive power mode or two-cycle compression release engine braking mode.

32 Claims, 9 Drawing Sheets t82 t52
t82 t52

60a
30b 60b
30a
60a
30b
60b 72a
72a'
72b
72b 42a
42b
-60°
0°
180°
360°
540°
720° t110
t82
t52 t110
t82
t52

60a
30b 60b
30a
60x
30b
60b 72a
72b
72b 42a
42b
-60°
0°
180°
360°
540°
720° t120
t82
t52 t120
t82
t52

60a
30b 60b
30x
60a
30b
60b 72b
72a
72a'
72b

42
-60°
0°
180°
360°
540°
720° t120
t110
t82
t52 t120
t110
t82
t52

60a
30b 30b
60b
30x
60x
60b 72a
72b
72b

42
-60°
0°
180°
360°
540°
720°

FOUR-CYCLE INTERNAL COMBUSTION ENGINES WITH TWO-CYCLE COMPRESSION RELEASE BRAKING

BACKGROUND OF THE INVENTION

This invention relates to variable timing valve actuation systems for internal combustion engines, and more particularly to apparatus for controlling, adjusting, or modifying the intake and exhaust valve timing or other related characteristics by hydraulically linking the timings of intake and exhaust systems with high speed electromagnetic valves to achieve compression release retarding effects during every crank shaft revolution.

Concurrently filed, commonly assigned application Ser. No. 08/512,528 shows how lost motion in hydraulic linkages between engine cylinder valves and the mechanical inputs which normally control those valves can be selectively employed to modify the valve openings in relation to the normal inputs. These modifications can be of the timing or amount of valve openings, or the operating mode of the engine can be changed from positive power to compression release braking. However, if the engine is a four-cycle engine in positive power mode, it will also have four cycles in compression release engine braking mode. This means that it is only possible for each engine cylinder to produce one compression release event during every two revolutions of the engine crank shaft.

Sickler U.S. Pat. No. 4,572,114 shows apparatus for converting a four-cycle engine to two-cycle operation during compression release engine braking. This enables each engine cylinder to produce a compression release event during each revolution of the engine crank shaft, thereby approximately doubling the available compression release braking as compared to four-cycle braking. However, the Sickler apparatus is relatively complicated, employing, for example, two hydraulic connections (e.g., 136 and 212 in FIG. 5 or 258 and 212 in FIG. 7) to each valve opening mechanism.

In view of the foregoing, it is an object of this invention to improve and simplify the selective conversion of four-cycle engines to two-cycle compression release engine braking.

It is another object of this invention to extend the operating principles of the above-mentioned concurrently filed application to facilitate selective operation of a four-cycle engine in two-cycle compression release engine braking mode.

SUMMARY OF THE INVENTION

These and other objects of the invention are accomplished in accordance with the principles of the invention by using hydraulic linkages with selective lost motion between the intake cams and intake valves and between the exhaust cams and exhaust valves of an internal combustion engine. Sufficient lobes may be provided on the cams to produce four-cycle positive power mode openings of the valves and two-cycle compression release engine braking mode operation of the engine, with the lost motion hydraulic linkages being operated to select either the four-cycle lobes or the two-cycle lobes. The hydraulic linkages for intake and exhaust valves may be selectively hydraulically interconnected to allow lobes on one type of cam to produce openings of the other type of valve when two-cycle operation is desired. This may allow the individual cam profiles to be somewhat simplified. The hydraulic linkages and the possible interconnections of those linkages are preferably controlled electronically (e.g., by a suitably programmed microprocessor). This control may be responsive not only to the desired mode of operation of the engine, but also to various engine or vehicle operating conditions so that the timings and/or extents of various valve openings can be adjusted and thereby optimized for current operating conditions in the current mode of operation of the engine.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
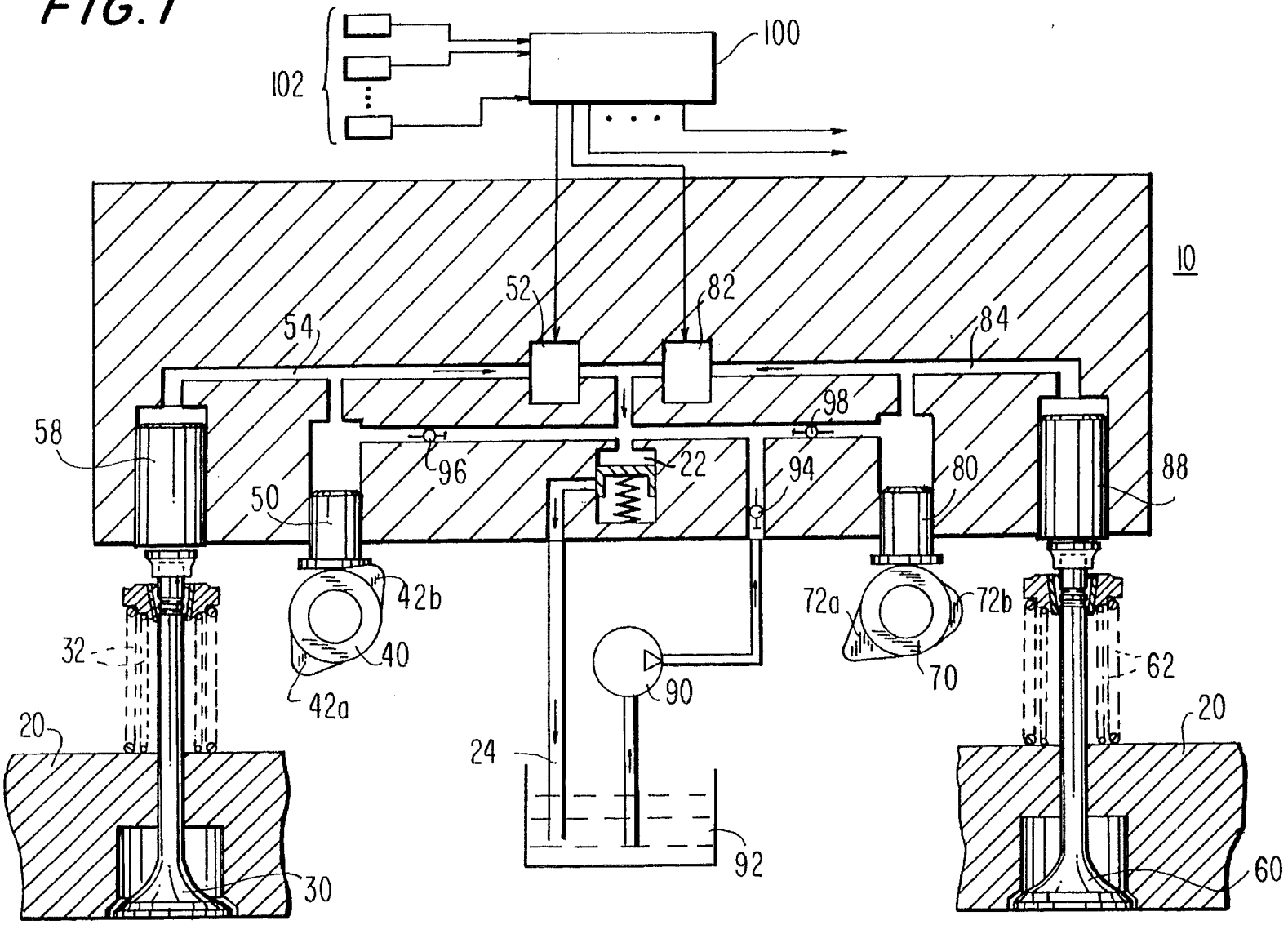
FIG. 1 is a simplified schematic diagram of a representative portion of an illustrative embodiment of an internal combustion engine constructed in accordance with this invention.

As shown in FIG. 1, an illustrative internal combustion engine 10 constructed in accordance with this invention has an engine cylinder head 20 with intake and exhaust valves 30 and 60 mounted for vertical reciprocation therein. Both of the depicted valves 30 and 60 serve one representative cylinder in engine 10. Intake valve 30 is resiliently biased upwardly toward the depicted closed position by prestressed compression coil springs 32. Exhaust valve 60 is similarly resiliently biased upwardly toward the depicted closed position by prestressed compression coil springs 62. Valve 30 can be pushed down to open it by downward motion of slave piston 58. Valve 60 can be pushed down to open it by downward motion of slave piston 88. Intake valve 30 has an associated rotating engine cam 40, and exhaust valve 60 similarly has an associated rotating engine cam 70. Intake and exhaust cams 40 and 70 rotate in synchronism with the crank shaft of the engine. Cams 40 and 70 have lobes 42 and 72 for producing openings of valves 30 and 60 as will be described in detail below.

Each of cams 40 and 70 is operatively linked to the associated valve 30 and 60 by hydraulic circuitry. Pump 90 supplies pressurized hydraulic fluid to this circuitry from sump 92. The hydraulic fluid may be engine lubricating oil, engine fuel, or any other suitable fluid. The output pressure of pump 90 is relatively low (e.g., 50 to 100 psi). This pressure is sufficient to fill the hydraulic circuit with fluid via check valves 94, 96, and 98, and to push master pistons 50 and 80 and slave pistons 58 and 88 out into contact with cams 40 and 70 and the tops of valves 30 and 60. However, the output pressure of pump 90 is not high enough to cause slave pistons 58 and 88 to open valves 30 and 60.

When an intake cam lobe 42 passes master piston 50, that cam lobe pushes the master piston in. If electronically controlled hydraulic fluid valve 52 is open when this occurs, the hydraulic fluid displaced by master piston 50 escapes from hydraulic subcircuit 54 via valve 52 and is accumulated in hydraulic fluid accumulator 22. Accumulator 22 maintains a quantity of hydraulic fluid at approximately the outlet pressure of pump 90 for immediate refilling of the rest of the hydraulic circuitry during return strokes of master pistons 50 and 80 which are not concurrent with return strokes of slave pistons 58 and 88. If accumulator 22 receives too much hydraulic fluid, its plunger moves down far enough to momentarily open a hydraulic fluid drain 24 back to sump 92.

If, rather than being open as described immediately above, valve 52 is closed when a cam lobe 42 passes master piston 50, hydraulic fluid is trapped in subcircuit 54. The pressure in this subcircuit therefore increases significantly, and the hydraulic fluid displaced by master piston 50 causes corresponding hydraulic displacement of slave piston 58. The resulting downward motion of the slave piston opens intake valve 30. When the above-mentioned lobe 42 has passed master piston 50, elements 50, 58, and 30 return to their original positions.

Lobes 72 on exhaust cam 70 cooperate with valve 82 (similar to valve 52) to selectively produce openings of exhaust valve 60 in a manner similar to that described above for elements 40, 50, 52, 54, 58, and 30. Thus if valve 82 is open when an exhaust cam lobe 72 passes master piston 80, the hydraulic fluid displaced by the master piston escapes from hydraulic subcircuit 84 to accumulator 22 via valve 82. This prevents slave piston 88 from opening exhaust valve 60. But if valve 82 is closed when an exhaust cam lobe 72 passes master piston 80, the pressure of the hydraulic fluid trapped in subcircuit 84 increases substantially. This causes slave piston 88 to move down and open valve 60. When the above-mentioned lobe 72 has passed master piston 80, elements 80, 88, and 60 return to their original positions.

The opening and closing of valves 52 and 82 (and other similar valves associated with the engine) is controlled by electronic control circuit 100. Control circuit 100, which may include a suitably programmed microprocessor, receives inputs from engine and/or vehicle sensors 102. These inputs enable control circuit 100 to maintain basic synchronization with the engine. They also enable the driver of the vehicle to select the mode of operation of the engine (e.g., positive power mode or compression release engine braking mode). And these inputs may provide information about various variable engine and/or vehicle operating parameters such as engine and/or vehicle speed. Control circuit 100 responds to its inputs by selecting the openings and closings of valves 52 and 82 that are appropriate to cause valves 30 and 60 to open and close as required for the desired engine operating mode. Control circuit 100 may also respond to these inputs by adjusting the timing and duration of the openings and closings of valves 52 and 82 so that the openings and closings of valves 30 and 60 are modified (e.g., with respect to timing, duration, and/or height) to optimize engine performance for current engine and/or vehicle operating conditions. Examples of the foregoing principles will now be discussed in connection with FIGS. 2*a* through 2*f*.

Figures 2A, 2B, 2C, 2D, 2E, 2F:
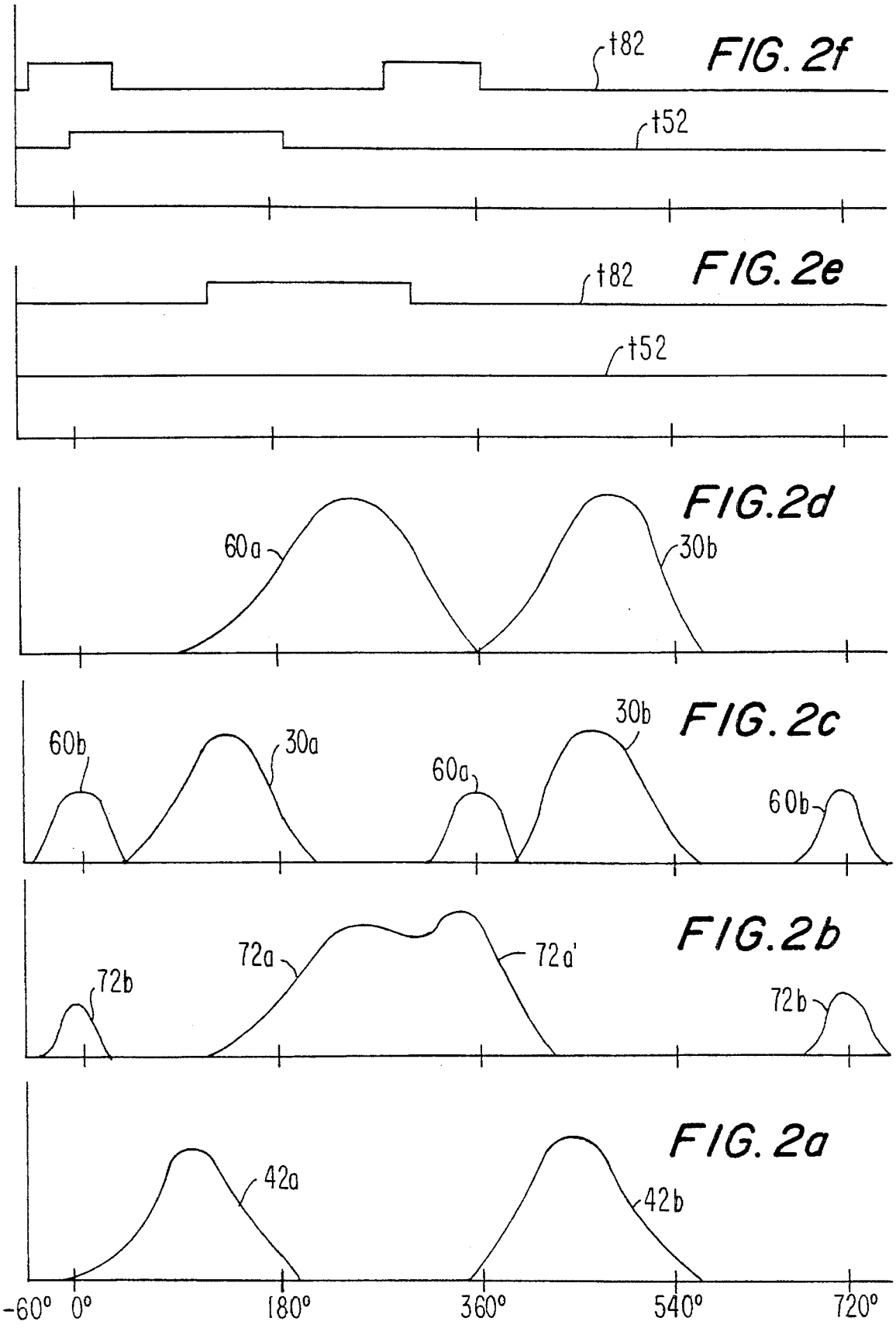
FIG. 2*a* is a simplified diagram of the lobes on the intake cam in the FIG. 1 apparatus.
FIG. 2*b* is a simplified diagram of the lobes on the exhaust cam in the FIG. 1 apparatus.
FIG. 2*c* is a simplified diagram of illustrative engine cylinder valve openings in the FIG. 1 apparatus during two-cycle compression release engine braking mode operation.
FIG. 2*d* is a simplified diagram of illustrative engine cylinder valve openings in the FIG. 1 apparatus during four-cycle positive power mode operation.
FIG. 2*e* is a simplified diagram of illustrative signal traces in the apparatus of FIG. 1 for controlling that apparatus to produce operation as shown in FIG. 2*c*.
FIG. 2*f* is a simplified diagram of illustrative signal traces in the apparatus of FIG. 1 for controlling that apparatus to produce operation as shown in FIG. 2*d*.

FIG. 2*a* shows the profile of intake cam 40 plotted against engine crankangle. (The same crankangle scale shown in FIG. 2*a* applies for all of the FIG. 2 group. Top dead center of the compression stroke of the associated engine cylinder in four-cycle positive power mode is at 0° and again at 720°.) FIG. 2*b* shows the profile of exhaust cam 70.

FIG. 2*c* shows the openings of valves 30 and 60 that are produced during two-cycle compression release engine braking mode. (In FIG. 2*c* and other similar FIGS. each opening of valve 30 is identified by the reference number 30, and each opening of valve 60 is identified by the reference number 60. The suffix letters "a" and "b" are used in FIG. 2*c* and similar FIGS. to indicate whether the valve opening is due to the "a" or "b" lobe on the associated cam 40/70.) FIG. 2*c* shows that intake valve 30 opens during each downward stroke of the associated engine piston in order to admit air to the associated engine cylinder. FIG. 2*c* further shows that exhaust valve 60 is opened near the end of each upward stroke of the associated engine piston to produce a release of compressed air to the exhaust manifold of the engine. A compression release event is therefore produced during each 360 degrees of rotation of the engine crank shaft, thereby producing two-cycle compression release engine braking. With compression release events thus occurring twice as frequently as in the case of four-cycle engine braking, approximately twice as much engine and vehicle retarding horsepower is available as compared to four-cycle compression release engine braking.

FIG. 2*d* shows the openings of valves 30 and 60 that are produced during four-cycle positive power mode operation of the engine.

FIG. 2*e* shows the signal traces produced by control circuit 100 for controlling valves 52 (lower signal trace t52) and 82 (upper signal trace t82) during compression release engine braking mode operation of the engine. In these (and other similar signal traces) the valve 52 or 82 is closed when the associated signal trace is low, and the valve is open when the signal trace is high. In FIG. 2*e* the signal for controlling valve 52 is low at all times. Valve 52 is therefore closed at all times during compression release engine braking, and intake valve 30 opens in response to both of intake cam lobes 42*a* and 42*b*. The signal for controlling valve 82, on the other hand, is high during the initial portion of exhaust cam lobe 72*a* and low during a trailing portion of that cam lobe (which includes an additional prominence 72*a'*) and at all other times. Valve 82 is therefore open during the initial portion of cam lobe 72*a* but closed during additional prominence 72*a'* and during lobe 72*b*. Exhaust valve 60 accordingly remains closed during the initial portion of lobe 72*a*, but opens (as at 60*a* in FIG. 2*c*) in response to additional prominence 72*a'*. Exhaust valve 60 also opens (as at 60*b* in FIG. 2*c*) in response to lobe 72*b*.

FIG. 2*f* shows the signal traces produced by control circuit 100 for controlling valves 52 (lower signal trace t52) and 82 (upper signal trace t82) during positive power-mode operation of the engine. The signal for controlling valve 52 is high during intake cam lobe 42*a* but low during intake cam lobe 42*b*. Valve 52 is therefore open during lobe 42*a* but closed during lobe 42*b*. This allows intake valve 30 to completely ignore lobe 42*a* by remaining closed during that lobe. Valve 30 does, however, open (as at 30*b* in FIG. 2*d*) in response to lobe 42*b*. The signal for controlling valve 82 in FIG. 2*f* is high during exhaust cam lobe 72*b* and the latter portion of exhaust cam lobe 72*a*. At other times this signal is low. Valve 82 is therefore open during lobe 72*b* and the latter portion of lobe 72*a* but closed during the initial portion of lobe 72*a*. This allows exhaust valve 60 to remain closed during lobe 72*b*, thereby completely ignoring that lobe. Exhaust valve 60 opens (as at 60*a* in FIG. 2*d*) in response to the initial portion of lobe 72*a*, but it ignores the trailing prominence 72*a'* on that lobe and instead closes by about crank angle 360°.

In addition to opening and closing valves 52 and 82 as described above in connection with FIG. 3 to select which cam lobes engine cylinder valves 30 and 60 respond to, control circuit 100 can make more subtle modifications in the timings of the operation of valves 52 and 82 to produce more subtle changes in the openings and closings of valves 30 and 60. For example, the start of a compression release event such as 60*a* or 60*b* in FIG. 2*c* can be delayed relative to the start of the associated cam feature by delaying the closing of valve 82 somewhat relative to the start of that cam feature. Similarly, a valve 30 or 60 can be closed early by opening the associated valve 52 or 82 before the end the cam feature that produced that engine valve opening. The distance that a valve 30 or 60 opens can also be selectively reduced by, for example, opening the associated valve 52 or 82 briefly before or as the peak of a cam feature is reached. It may be desirable to make these kinds of changes in engine valve operation to optimize the engine for various engine and/or vehicle operating conditions (e.g., changes in engine and/or vehicle speed). For example, such changes may optimize the amount of engine braking produced for various engine speeds or, in positive power mode, may optimize fuel consumption and/or engine emissions for various engine speeds. Control circuit 100 may be programmed to perform various algorithms or look up table operations to determine the precise engine valve timings that are most appropriate for the current values of the inputs 102 it is receiving. Control circuit 100 then produces the signals applied to valves 52 and 82 that are required to produce those engine valve timings.

The various kinds of more subtle modification of engine valve operation in relation to engine cam features that have just been described are further described and illustrated in above-mentioned application Ser. No. 08/512,528, which is hereby incorporated by reference herein.

It will be seen from the foregoing that the apparatus of this invention provides a simple and effective way to operate an internal combustion engine in either four-cycle positive power mode or two-cycle compression release engine braking mode, as well as to make more subtle modifications of valve timing relative to cam features.

Figure 3:
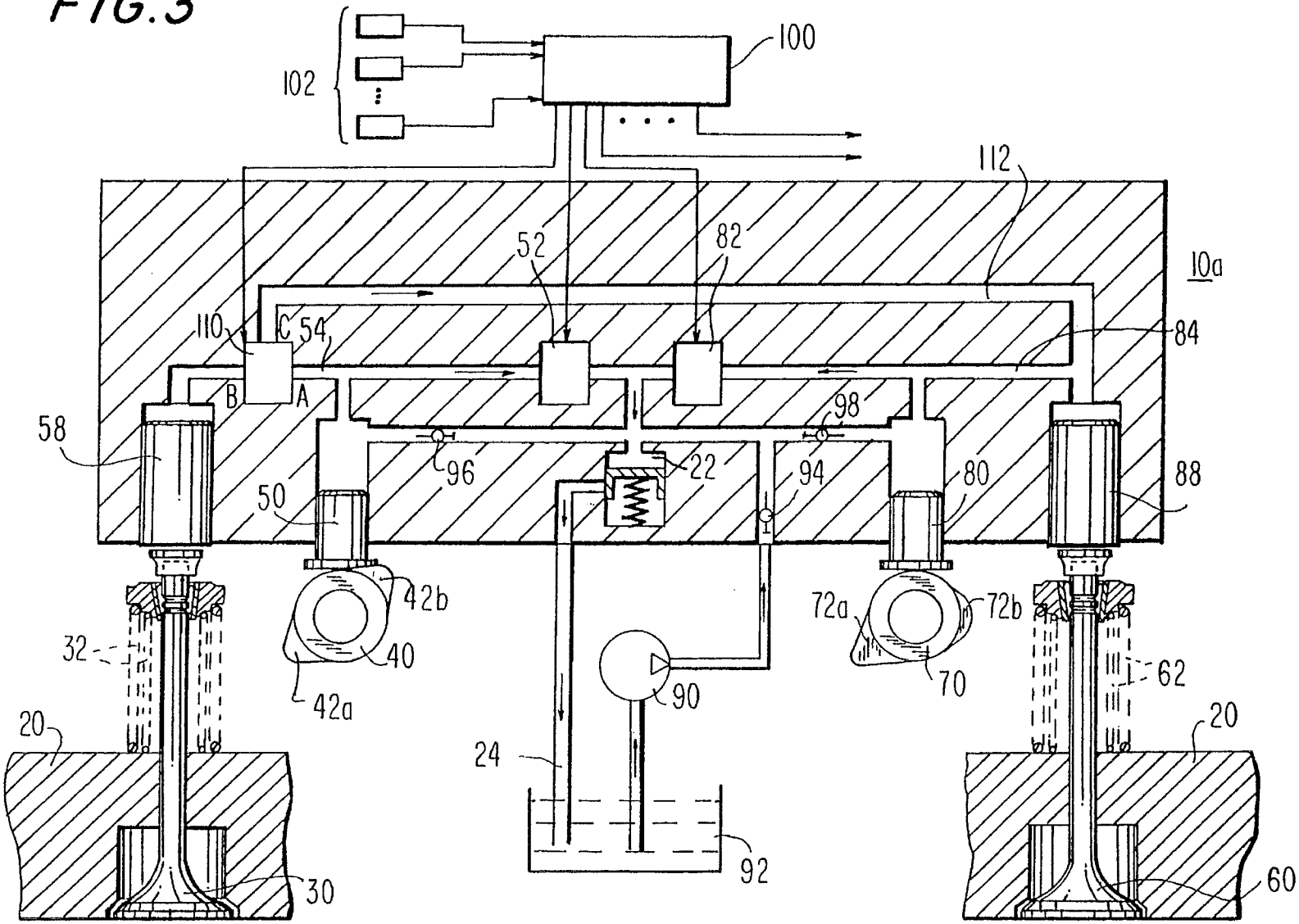
FIG. 3 is a view similar to FIG. 1, but shows an alternative embodiment of the invention.

FIG. 3 shows an alternative embodiment of the invention in which part of an intake cam lobe is used during compression release engine braking to produce a compression-releasing exhaust valve opening. The apparatus 10*a* shown in FIG. 3 has many similarities to the FIG. 1 apparatus, and the same reference numbers are used for basically similar elements in both FIGS. In addition to electronically controlled hydraulic fluid valves 52 and 82, the apparatus shown in FIG. 3 has another electronically controlled hydraulic fluid diverter or valve 110 which can be switched to hydraulically connect either its ports A and B or its ports A and C. Port C is connected to hydraulic subcircuit 84 via conduit 112. Like valves 52 and 82, valve 110 is controlled by electronic control circuit 100. The operation of the apparatus shown in FIG. 3 will now be explained with reference to FIGS. 4*a* through 4*f* (respectively similar to FIGS. 2*a* though 2*f*).

Figures 4A, 4B, 4C, 4D, 4E, 4F:
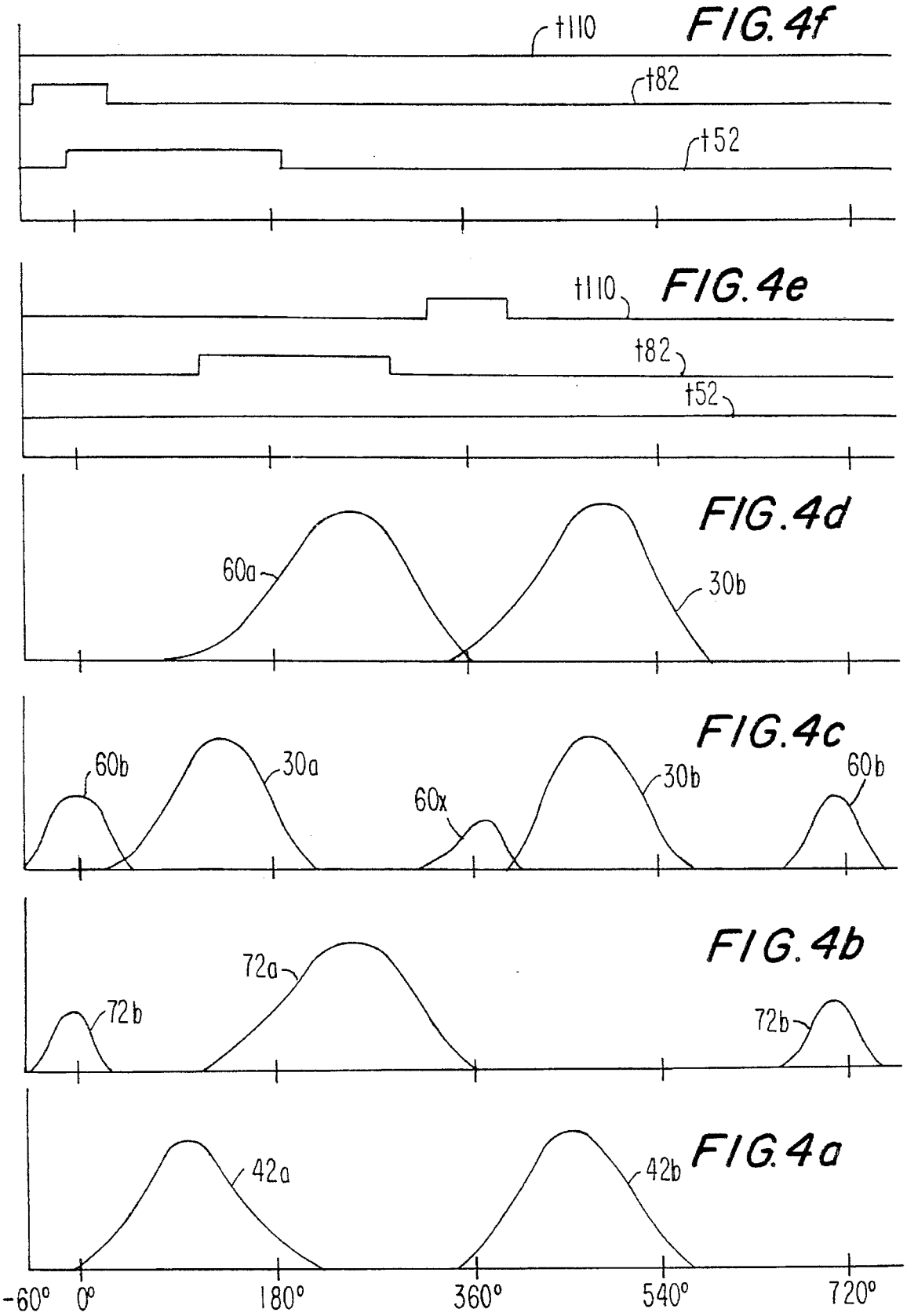
FIG. 4*a* through 4*f* are respectively similar to FIGS. 2*a* through 2*f*, but for the alternative embodiment shown in FIG. 3.

FIG. 4*a* shows the profile of intake cam 40 in FIG. 3. Note that, as is often the case in conventional engines, intake cam lobe 42*b* begins somewhat before top dead center of the exhaust stroke (i.e., somewhat before crankangle 360°). FIG. 4*b* shows the profile of exhaust cam 70 in FIG. 3. Note that exhaust cam lobe 72*a* in FIG. 4 does not require the additional trailing prominence 72*a'* shown in FIG. 2*b*.

FIG. 4*c* shows the openings of intake and exhaust valves 30 and 60 during two-cycle compression release engine braking operation of engine 10*a*. This pattern is very similar to the pattern shown in FIG. 2*c*, except that exhaust valve opening 60*x* (which takes the place of exhaust valve opening 60*a* in FIG. 2*c*) is produced by an initial portion of intake cam lobe 42*b* as will be more fully described in connection with FIG. 4*e*. FIG. 4*d* shows the openings of intake and exhaust valves 30 and 60 during four-cycle positive power mode operation of engine 10*a*.

FIG. 4*e* shows the signal traces produced by control circuit 100 during two-cycle compression release engine braking mode operation of engine 10*a* to control valve 52 (bottom signal trace t52), valve 82 (middle signal trace t82), and valve 110 (top signal trace t110). As in similar FIG. 2*e*, each of the lower two signal traces in FIG. 4*e* is low when the associated valve 52 or 82 is closed, and high when the associated valve is open. The top signal trace in FIG. 4*e* is low when valve 110 hydraulically connects its ports A and B, and high when valve 110 hydraulically connects its ports A and C. The bottom signal trace is low at all times in FIG. 4*e*. The middle signal trace is low except during the initial portion of exhaust cam lobe 72*a*. The top signal trace causes valve 110 to connect its A and B ports at all times except during an initial portion of intake cam lobe 42*b*.

FIG. 4*f* shows the signal traces produced by control circuit 100 during four-cycle positive power mode operation of engine 10*a*. Again, the bottom signal t52 in FIG. 4*f* controls valve 52, the middle signal t82 controls valve 82, and the top signal t110 controls valve 110. The bottom signal trace is high during intake cam lobe 42*a*, which causes intake valve 30 to completely ignore intake cam lobe 42*a*. However, this signal is low during lobe 42*b* so that intake valve 30 opens in response to that lobe as shown at 30*b* in FIG. 4*d*. The middle signal trace in FIG. 4*f* is low except during exhaust cam lobe 72*b*. This causes exhaust valve 60 to open (as shown at 60*a* in FIG. 4*d*) in response to exhaust cam lobe 72*a*, but to remain closed during lobe 72*b*. The top signal trace in FIG. 4*f* is low at all times so that valve 110 connects its A and B ports at all times.

As a result of the signals shown in FIG. 4*e*, intake valve 30 opens (as at 30*a* in FIG. 4*c*) in response to intake cam lobe 42*a* and (as at 30*b* in FIG. 4*c*) in response to at least a latter portion of intake cam lobe 42*b*. Also as a result of the signals shown in FIG. 4*d*, exhaust valve 60 opens (as at 60*b* in FIG. 4*c*) in response to exhaust cam lobe 72*b*. Exhaust valve 60 does not open during exhaust cam lobe 72*a* because valve 82 is open during the forward stroke of master piston 80 in response to that cam lobe. However, toward the end of lobe 72*a* valve 82 closes and valve 110 switches to its port A-C position. This allows high pressure hydraulic fluid propelled by master piston 50 at the start of intake cam lobe 42*b* to flow to slave piston 88, thereby opening exhaust valve 60 as shown at 60*x* in FIG. 4*c*. As soon as an adequate exhaust valve opening 60*x* has been produced, valve 110 switches back to its port A-B position. This allows exhaust valve 60 to close and causes the remainder of the forward stroke of master piston 50 to produce the opening of intake valve 30 which is shown at 30*b* in FIG. 4*c*.

From the foregoing it will be seen that the apparatus of FIG. 3 provides an alternative way of operating an engine in either four-cycle positive power mode or two-cycle compression release engine braking mode. In addition, any of the above-described more subtle types of modifications of engine valve response to cam features can also be implemented in the apparatus shown in FIG. 3.

Figure 5:
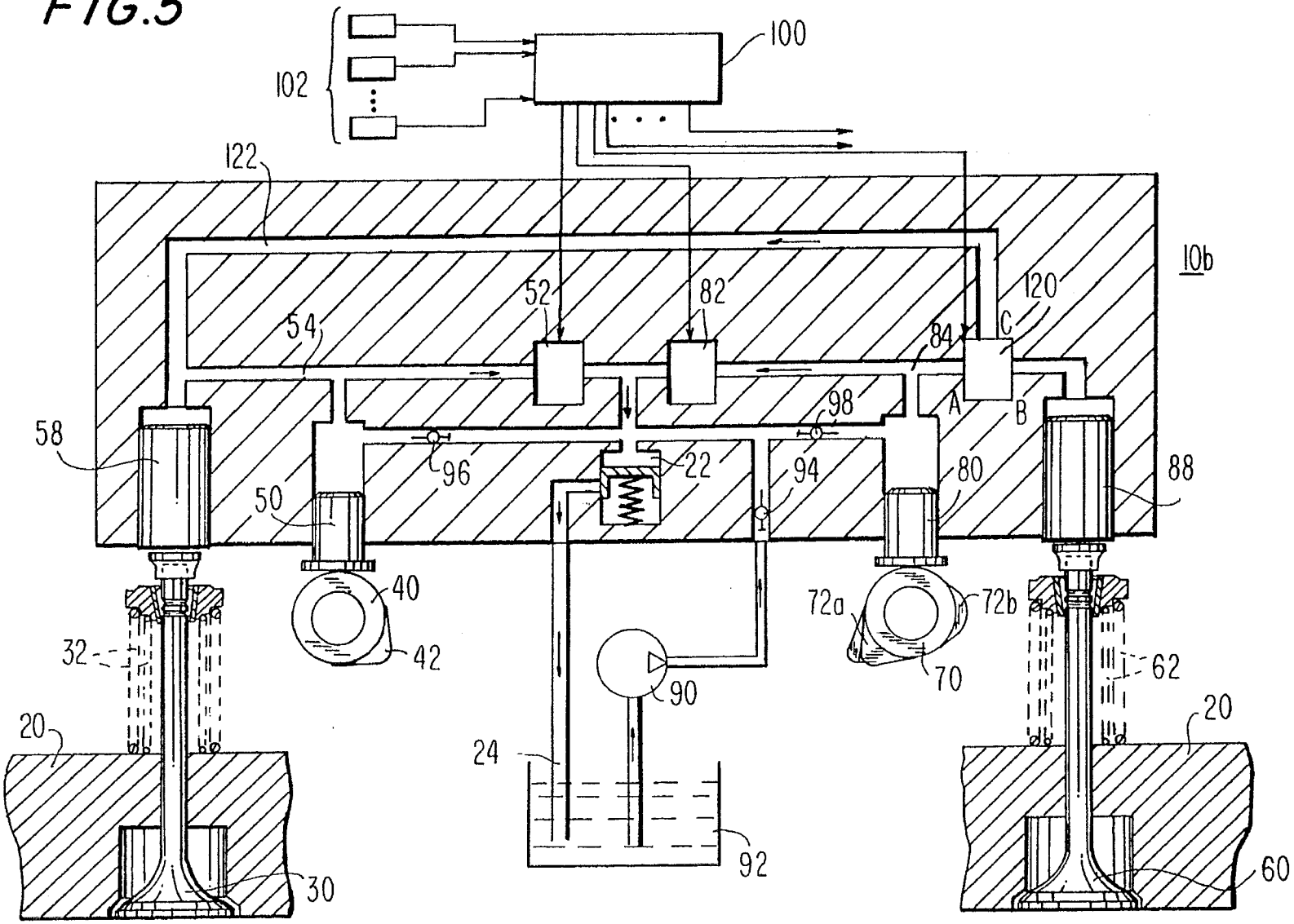
FIG. 5 is another view similar to FIG. 1, but shows another alternative embodiment of the invention.

FIG. 5 shows another alternative embodiment of the invention in which part of an exhaust cam lobe is used during compression release engine braking to produce an extra intake valve opening. Once again, the apparatus 10*b* shown in FIG. 5 has many similarities to the FIG. 1 apparatus, and the same reference numbers are used for similar elements in both FIGS. Apparatus 10*b* has an additional electronically controlled hydraulic fluid diverter or valve 120 which can be switched to hydraulically connect either its ports A and B or its ports A and C. Port C is connected to hydraulic subcircuit 54 via conduit 122. Valve 120 is controlled by electronic control circuit 100. The operation of apparatus 10*b* will be explained with references to FIGS. 6*a* through 6*f*, which are respectively similar to FIGS. 2*a* through 2*f* or FIGS. 4*a* through 4*f*.

Figures 6A, 6B, 6C, 6D, 6E, 6F:
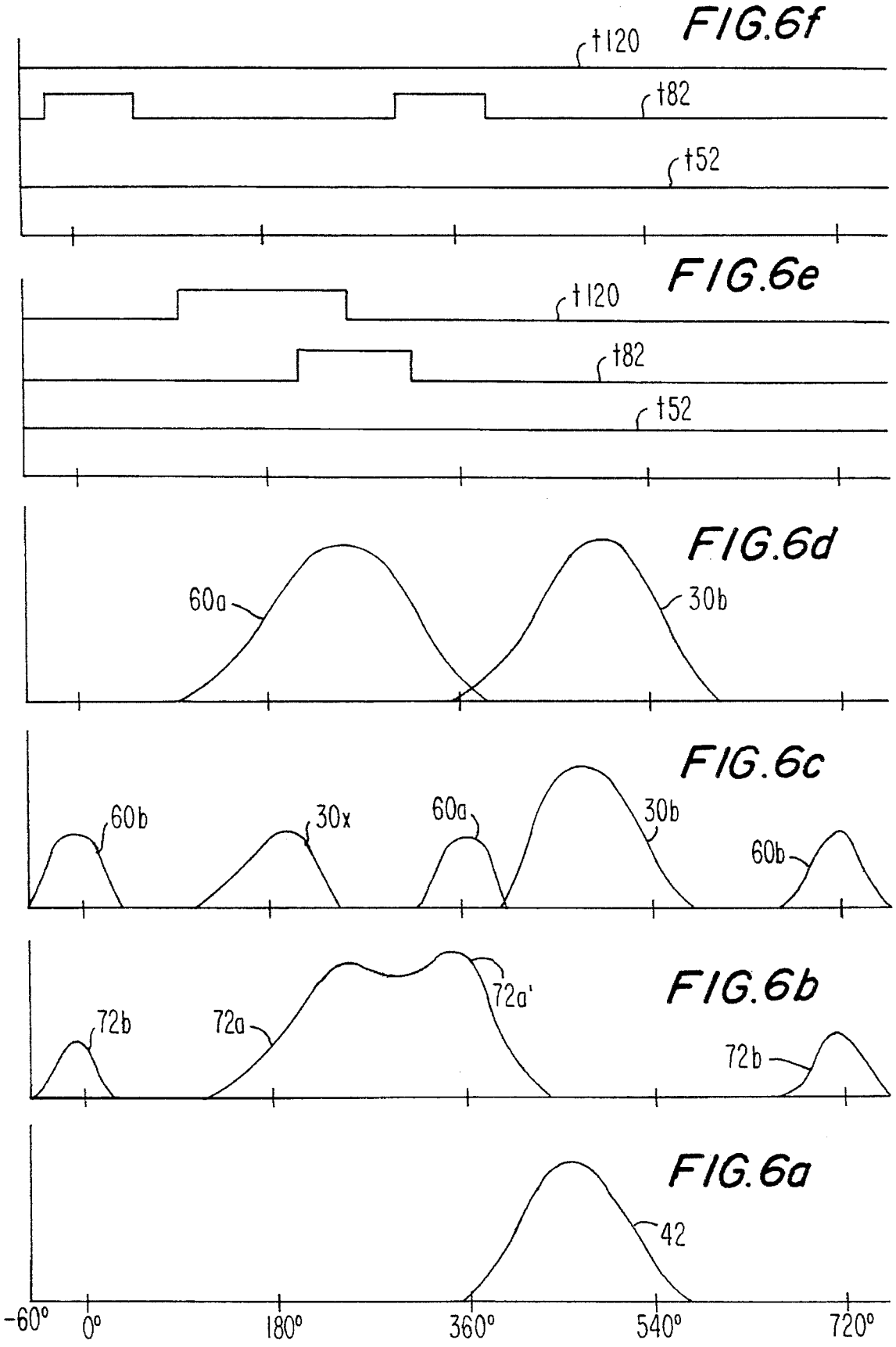
FIGS. 6*a* through 6*f* are respectively similar to FIGS. 2*a* through 2*f*, but for the alternative embodiment shown in FIG. 5.

FIGS. 5 and 6*a* show that intake cam 40 has only one lobe 42. FIGS. 5 and 6*b* show that exhaust cam 70 has two lobes 72*a* and 72*b*.

FIG. 6*c* shows that during two-cycle compression release engine braking, exhaust valve 60 opens at 60*b* in response to exhaust cam lobe 72*b*. Exhaust valve 60 also opens at 60*a* in response to an additional trailing prominence 72*a'* on lobe 72*a*. Intake valve 30 opens at 30*x* in response to an initial portion of exhaust cam lobe 72*a* and at 30*b* in response to intake cam lobe 42.

FIG. 6*d* shows that during four-cycle positive power mode, exhaust valve 60 opens at 60*a* in response to the initial portion of exhaust cam lobe 72*a*. Intake valve 30 opens at 30*b* in response to intake cam lobe 42.

In FIGS. 6*e* and 6*f* the top signal trace t120 controls valve 120. This trace is low for connection of valve port A to valve port B. This trace is high for connection of valve port A to valve port C. (In FIG. 6*f* this trace is low at all times.) The bottom trace t52 in FIGS. 6*e* and 6*f* controls valve 52 (high for open; low for closed). This trace is low at all times in both FIGS. 6*e* and 6*f*, but valve 52 could be opened momentarily to make the more subtle adjustments of intake valve response as described above in connection with the other embodiments. The middle trace t82 in FIGS. 6*e* and 6*f* controls valve 82 (high for open; low for closed). As shown by the top trace t120 in FIG. 6*e*, valve 120 is switched to connect port A to port C during an initial portion of exhaust cam lobe 72*a*. This causes the initial portion of the forward stroke of master piston 80 in response to that lobe to open intake valve 30 as shown at 30*x* in FIG. 6*c*. After a suitable opening 30*x* has been produced, valve 82 is opened to suppress the intermediate portion of lobe 72*a* and to allow valve 30 to re-close. Valve 120 is then returned to the condition in which it connects port A to port B. Valve 82 is re-closed when additional prominence 72*a'* is about to begin. Accordingly, additional prominence 72*a'* causes exhaust valve 60 to open as shown at 60*a* in FIG. 6*c*.

In FIG. 6*f* the middle signal trace t82 shows that valve 82 is open during exhaust cam lobe 60*b* and the additional prominence 72*a'* on lobe 72*a*. This allows exhaust valve 60 to ignore these exhaust cam features during positive power mode operation of engine 10*b*.

Once again, the more subtle timing modifications described above in connection with the other embodiments can also be employed in the embodiment shown in FIG. 5.

FIGS. 6*e* and 6*f* show valve 52 remaining closed at all times during both modes of operation of engine 10*b*. Valve 52 and the hydraulic circuit path through that valve can therefore be eliminated from engine 10*b* if desired. On the other hand, it may be desired to retain valve 52 for the purpose of making certain of the more subtle timing modifications mentioned in the preceding paragraph.

Figure 7:
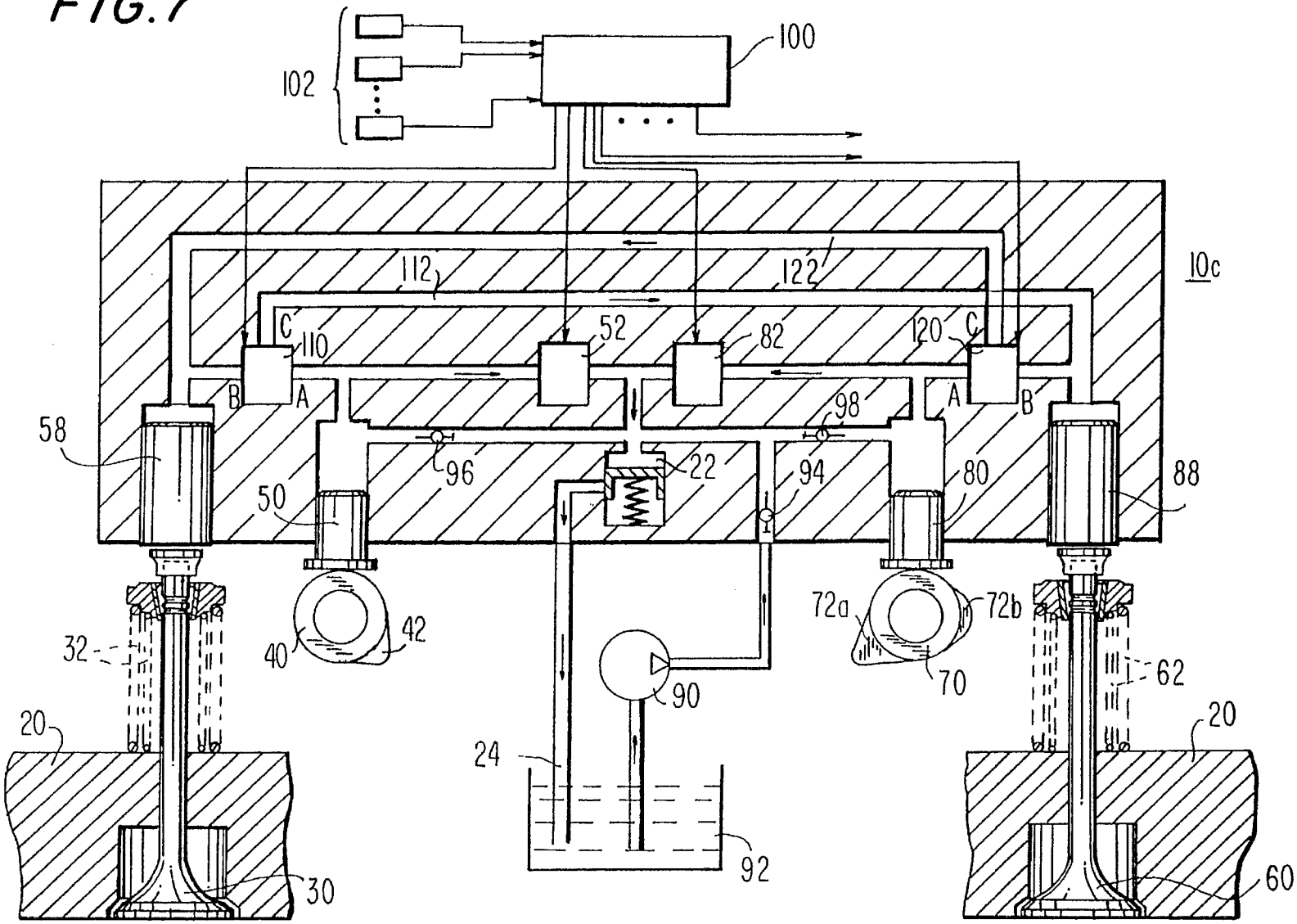
FIG. 7 is still another view similar to FIG. 1, but shows still another alternative embodiment of the invention.

Still another embodiment is shown in FIG. 7. Elements that are similar to elements in previously described embodiments are again identified by the same reference numbers.

Figures 8A, 8B, 8C, 8D, 8E, 8F:
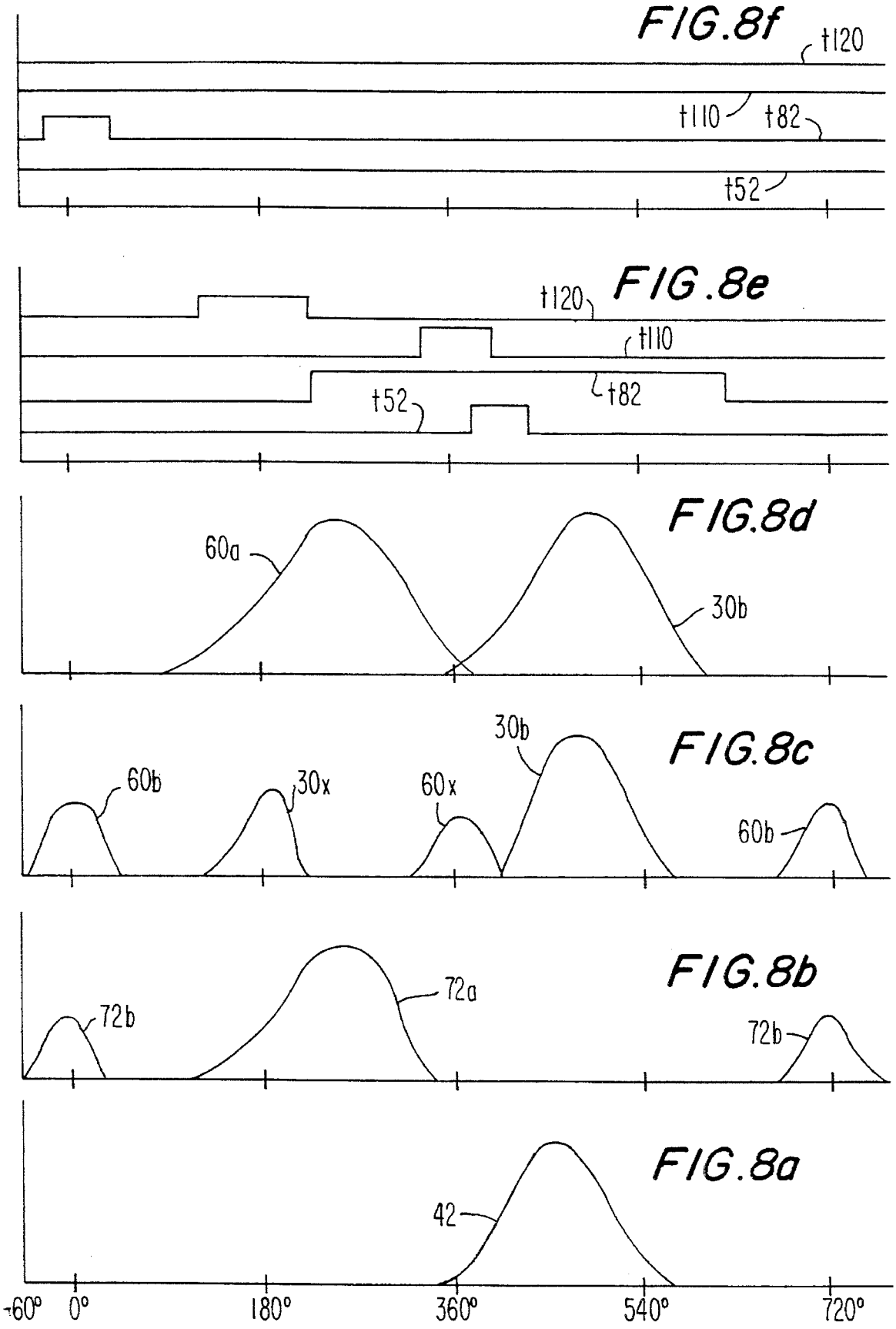
FIGS. 8*a* through 8*f* are respectively similar to FIGS. 2*a* through 2*f*, but for the alternative embodiment shown in FIG. 7.

FIGS. 8*a* through 8*f* relate to the embodiment shown in FIG. 7 and are respectively similar to FIGS. 2*a* through 2*f*, FIGS. 4*a* through 4*f*, or FIGS. 6*a* through 6*f*. FIG. 8*a* shows the profile of intake cam 40. FIG. 8*b* shows the profile of exhaust cam 70.

In the two-cycle compression release engine braking mode operation shown in FIG. 8*c* exhaust valve opening 60*b* is produced by exhaust cam lobe 72*b*, while exhaust valve opening 60*x* is produced by an initial portion of intake cam lobe 42. Also in FIG. 8*c* intake valve opening 30*x* is produced by the initial portion of exhaust cam lobe 72*a*, while intake valve opening 30*b* is produced by the latter portion of intake cam lobe 42.

In the four-cycle positive power mode operation shown in FIG. 8*d* exhaust valve opening 60*a* is produced by exhaust cam lobe 72*a*, while intake valve opening 30*b* is produced by intake cam lobe 42.

The signal traces shown in FIG. 8*e* are for two-cycle engine braking, while FIG. 8*f* shows these signal traces for four-cycle positive power mode operation. In FIGS. 8*e* and 8*f* the top trace t120 is for control of valve 120 and the second trace t110 is for control of valve 110. In each case the trace is low for connection of valve ports A and B, and the trace is high for connection of valve ports A and C. The third and fourth traces are for control of valves 82 and 52, respectively. In each case the trace is low for closing the associated valve, and high for opening the associated valve.

In order for exhaust cam lobe 72*b* to produce exhaust valve opening 60*b* in two-cycle compression release engine braking mode (FIG. 2*c*), valve 82 is closed and valve 120 is in its A-B position during lobe 72*b*. In order for the initial portion of exhaust cam lobe 72*a* to produce intake valve opening 30*x*, valve 82 is closed and valve 120 is in its A-C position during this portion of lobe 72*a*. This causes pressurized hydraulic fluid to flow from master piston 80 through valve 120 (ports A-C) and conduit 122 to slave piston 58, thereby opening intake valve 30. As soon as an adequate opening 30*x* of the intake valve has been produced, valve 82 is opened to release further hydraulic fluid pressure from master piston 80 to accumulator 22. Valve 120 may also then be restored to its A-B position. Valve 82 can be re-closed at any time after exhaust cam lobe 72*a*. In order for the initial portion of intake cam lobe 42 to produce exhaust valve opening 60*x*, valve 52 is closed and valve 110 is in its A-C position during this portion of lobe 42. This causes pressurized hydraulic fluid from master piston 50 to flow through valve 110 (ports A-C) and conduit 112 to slave piston 88, thereby opening exhaust valve 60 as shown at 60*x* in FIG. 8*c*. As soon as an adequate opening of the exhaust valve has been produced, valve 52 opens briefly to vent some hydraulic fluid to accumulator 22. This allows exhaust valve 60 to re-close. Valve 110 is then returned to its A-B position and valve 52 is re-closed so that the remaining portion of intake cam lobe 42 causes intake valve 30 to open as shown at 30*b* in FIG. 8*c*.

In FIG. 8*f* valves 110 and 120 remain in their A-B positions at all times. Similarly, valve 52 remains closed at all times. Valve 82 is closed at all times except during exhaust cam lobe 72*b* when valve 82 is opened so that exhaust valve 60 will not open in response to that lobe.

Figure 9A:
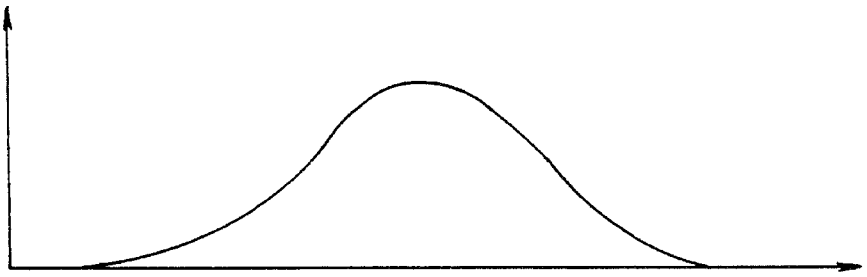
FIG. 9*a* is a diagram of an illustrative engine cam profile which is useful in explaining certain operating principles of the invention.
Figure 9B:
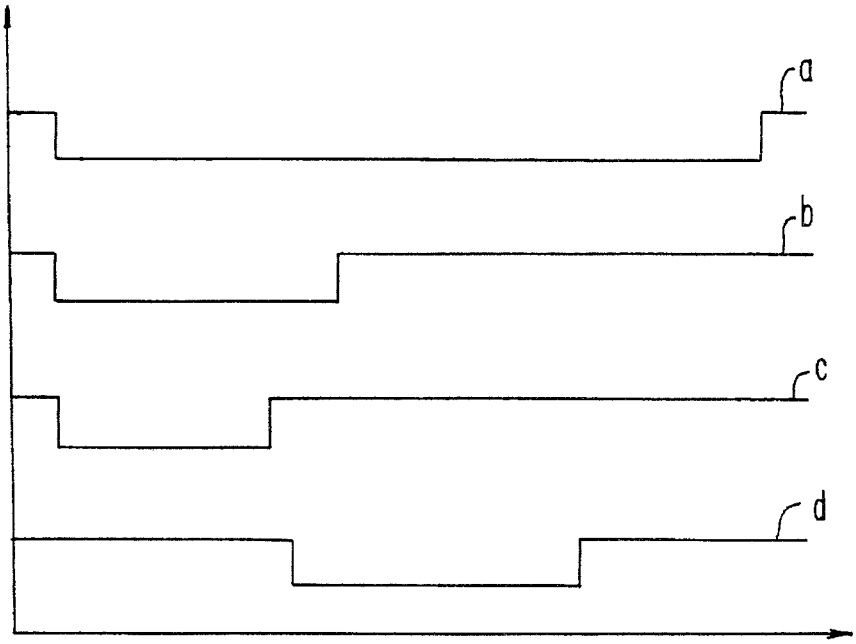
FIG. 9*b* is a diagram showing several alternative hydraulic valve control signals synchronized with the engine cam profile in FIG. 9*a* in accordance with this invention.
Figure 9C:
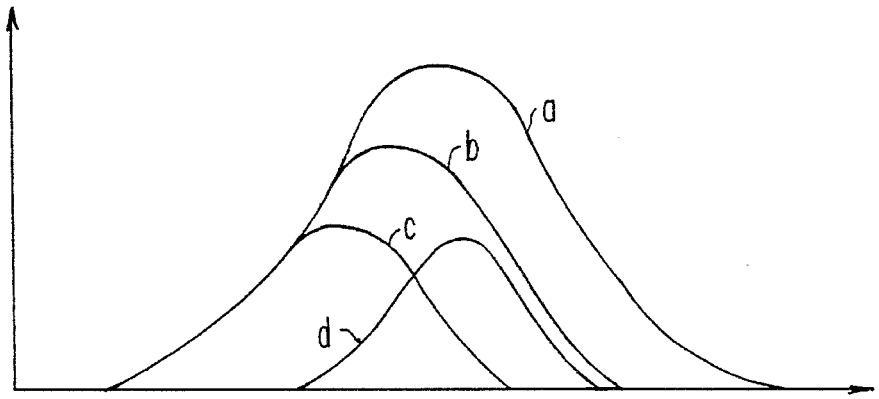
FIG. 9*c* is a diagram showing several alternative engine valve openings in response to the engine cam profile in FIG. 9*a* and the hydraulic valve control signals in FIG. 9*b*.

It has been mentioned several times in the foregoing discussion that control of valves such as 52, 82, etc. can also be used to produce more subtle variations in engine valve timing, amount of engine valve opening, etc. Application Ser. No. 08/512,528, which shows and describes this principle in somewhat related apparatus, has been incorporated by reference herein. FIGS. 9*a–c* herein also provide several examples of this principle. An illustrative engine cam profile is shown in FIG. 9*a*. Various possible signals for controlling trigger valves like 52, 82, etc. are shown in FIG. 9*b*, which is synchronized with FIG. 9*a*. These signals are respectively identified as a, b, c, and d. The various openings of an engine valve such as 30 or 60 in response to the FIG. 9*a* cam profile and an associated trigger valve controlled by the FIG. 9*b* control signals are shown in FIG. 9*c*. For example, the engine valve opens as shown at a in FIG. 9*c* when the associated trigger valve is controlled by signal a in FIG. 9*b*. Signal a keeps the trigger valve closed throughout the entirety of the engine cam, thereby causing the engine valve opening to follow the full engine cam profile. As shown at b in FIG. 9*c*, the engine valve opens by a lesser amount and closes earlier when the associated trigger valve is opened before the engine cam profile reaches its peak as shown by signal b in FIG. 9*b*. As shown at c in FIG. 9*c*, these trends are even more pronounced when the associated trigger valve is opened even earlier as shown by signal c in FIG. 9*b*. As shown at d in FIG. 9*c*, the opening of the engine valve can be delayed relative to the start of the engine cam profile by leaving the associated trigger valve open until after the cam profile has begun (see signal d in FIG. 9*b*)). Still other examples of these kinds of engine valve opening modifications are shown and described in the other application (Ser. No. 08/512,528) which has been incorporated by reference herein.

The systems of this invention can have a number of additional advantages. Use of the hydraulic lost motion to modify or eliminate certain positive cam motions and thereby alter engine valve timing and displacement may be useful to improve fuel economy in positive power mode. By closing certain engine valves earlier in cold weather in positive power mode, the system can be used as an engine warm-up device. During two-stroke engine braking mode operation the engine exhaust valves may be opened to allow reverse flow from the exhaust manifold into the engine cylinders. This supercharges the engine cylinders to increase engine braking performance. Changing exhaust valve timing in positive power mode operation of the engine can be used to recirculate some exhaust gas and thereby reduce particle emissions.

It will be understood that the foregoing is only illustrative of the principles of this invention and that various modifications can be made by those skilled in the art. For example, FIGS. 1, 3, 5, and 7 all suggest that the engine has one intake and one exhaust valve 30 and 60 per engine cylinder. It is quite common for engines to have two intake and two exhaust valves per cylinder, and it will be readily apparent that this invention is equally applicable to such engines.

The invention claimed is:

1. An internal combustion engine comprising;

an intake valve associated with a cylinder of said engine;

an exhaust valve associated with said cylinder;

an intake cam having at least one lobe synchronized with possible openings of said intake valve;

an exhaust cam having a plurality of lobes synchronized with possible openings of said exhaust valve;

a first hydraulic linkage containing hydraulic fluid operatively coupled between said intake cam and said intake valve for selectively responding to said intake cam lobe by causing said intake valve to open;

a second hydraulic linkage containing hydraulic fluid operatively coupled between said exhaust cam and said exhaust valve for selectively responding to said exhaust cam lobes by causing said exhaust valve to open;

a first hydraulic fluid control for selectively controlling hydraulic fluid pressure in said first hydraulic linkage to selectively modify the openings of said intake valve in response to said intake cam lobe; and a second hydraulic fluid control for selectively controlling hydraulic fluid pressure in said second hydraulic linkage to selectively modify the openings of said exhaust valve in response to said exhaust cam lobe.

2. The apparatus defined in claim 1 wherein at least one of said hydraulic fluid controls comprises a valve for selectively releasing hydraulic fluid from the hydraulic linkage associated with that hydraulic fluid control.

3. The apparatus defined in claim 2 wherein said valve is an electrically operated valve controlled by electronic control circuitry.

4. The apparatus defined in claim 3 wherein said electronic control circuitry includes a microprocessor.

5. The apparatus defined in claim 3 further comprising:

a sensor for monitoring an operating parameter of said engine and for producing an output signal indicative of said parameter, which output signal is applied to said electronic control circuitry for causing said control circuitry to modify operation of said electrically operated valve in accordance with said parameter.

6. The apparatus defined in claim 5 wherein said parameter includes an indication of whether said engine is to be in positive power mode or compression release engine braking mode.

7. The apparatus defined in claim 6 wherein said control circuit is responsive to said output signal of said sensor (1) by operating said electrically operated valve to produce four-cycle positive power mode operation of said engine when said indication indicates that said engine is to be in positive power mode, and (2) by operating said electrically operated valve to produce two-cycle compression release engine braking mode operation of said engine when said indication indicates that said engine is to be in compression release engine braking mode.

8. The apparatus defined in claim 1 wherein at least one of said hydraulic linkages comprises:

a master piston that reciprocates in response to the lobe or lobes on the cam to which that hydraulic linkage is operatively coupled; and a slave piston that selectively reciprocates in response to hydraulic fluid pressure and flow in said hydraulic linkage in order to selectively open the valve to which that hydraulic linkage is operatively coupled.

9. The apparatus defined in claim 1 wherein said second hydraulic fluid control is selectively operable to allow said exhaust valve to remain completely closed in response to any first one of said lobes on said exhaust cam and to open in response to any second one of said lobes on said exhaust cam.

10. The apparatus defined in claim 1 wherein said intake cam has a plurality of lobes, and wherein said first hydraulic fluid control is selectively operable to allow said intake valve to remain completely closed in response to any first one of said lobes on said intake cam and to open in response to any second one of said lobes on said intake cam.

11. The apparatus defined in claim 1 further comprising:

a hydraulic interconnection for selectively interconnecting said first and second hydraulic linkages so that a hydraulic pressure pulse in one of said linkages is transmitted to the other of said linkages to open the valve to which said other of said linkages is operatively coupled.

12. The apparatus defined in claim 11 wherein said hydraulic pressure pulse is produced in said one of said linkages by a lobe on the cam to which said one of said linkages is operatively coupled.

13. The apparatus defined in claim 12 wherein said hydraulic interconnection comprises a hydraulic fluid diverter for selectively diverting hydraulic coupling of said one of said linkages from the valve to which said one of said linkages is otherwise coupled to the valve to which said other of said linkages is coupled.

14. The apparatus defined in claim 13 wherein said diverter is an electrically operated valve controlled by electronic control circuitry.

15. The apparatus defined in claim 14 wherein said electronic control circuitry includes a microprocessor.

16. The apparatus defined in claim 14 further comprising:

a sensor for monitoring an operating parameter of said engine and for producing an output signal indicative of said parameter, which output signal is applied to said electronic control circuitry for causing said control circuitry to modify operation of said electrically operated valve in accordance with said parameter.

17. The apparatus defined in claim 16 wherein said parameter includes an indication of whether said engine is to be in positive power mode or compression release engine braking mode.

18. The apparatus defined in claim 17 wherein said control circuit is responsive to said output signal of said sensor (1) by operating said electrically operated valve to produce four-cycle positive power mode operation of said engine when said indication indicates that said engine is to be in positive power mode, and (2) by operating said electrically operated valve to produce two-cycle compression release engine braking mode operation of said engine when said indication indicates that said engine is to be in compression release engine braking mode.

19. The apparatus defined in claim 11 wherein said hydraulic interconnection is a first such interconnection for selectively transmitting a hydraulic pressure pulse from said first hydraulic linkage, and wherein said apparatus further comprises;

a second hydraulic interconnection for selectively transmitting a hydraulic pressure pulse from said second hydraulic linkage to said first hydraulic linkage to open said intake valve.

20. The apparatus defined in claim 19 wherein said hydraulic pressure pulse transmitted by said second hydraulic interconnection is produced in said second hydraulic linkage by a lobe on said exhaust cam.

21. The apparatus defined in claim 20 wherein said hydraulic fluid diverter is a first such diverter, and wherein said second hydraulic interconnection comprises a second hydraulic fluid diverter for selectively diverting hydraulic coupling of said second hydraulic linkage from said exhaust valve to said intake valve.

22. The apparatus defined in claim 21 wherein said second diverter is an electrically operated valve controlled by electronic control circuitry.

23. The apparatus defined in claim 22 wherein said electronic control circuitry includes a microprocessor.

24. An internal combustion engine comprising:

an intake valve associated with a cylinder of said engine;

an exhaust valve associated with said cylinder;

an intake cam having at least one lobe synchronized with possible openings of said intake valve;

an exhaust cam having a plurality of lobes synchronized with possible openings of said exhaust valve;

a first hydraulic linkage including a first master piston reciprocated by said intake cam lobe, a first slave piston for reciprocating to open said intake valve, a first hydraulic fluid coupling between said first master piston and said first slave piston for selectively causing said first slave piston to reciprocate in response to reciprocation of said first master piston, and a first electrically controlled valve for selectively releasing hydraulic fluid pressure from said first coupling to modify the response of said first slave piston to reciprocation of said first master piston;

a second hydraulic linkage including a second master piston reciprocated by said exhaust cam lobes, a second slave piston for reciprocating to open said exhaust valve, a second hydraulic fluid coupling between said second master piston and said second slave piston for selectively causing said second slave piston to reciprocate in response to reciprocation of said second master piston, and a second electrically controlled valve for selectively releasing hydraulic fluid pressure from said second coupling to modify the response of said second slave piston to reciprocation of said second master piston, said second valve being selectively operable to cause said exhaust valve to remain completely closed in response to any first one of said exhaust cam lobes and to open in response to any second one of said exhaust cam lobes; and electronic control circuitry for controlling said first and second valves.

25. The apparatus defined in claim 24 further comprising a sensor for indicating whether said engine is to be in positive power mode or compression release engine braking mode, and wherein said electronic control circuitry is responsive to said sensor by controlling said first and second valves to cause said engine to operate in positive power mode or compression release engine braking mode as called for by said sensor.

26. The apparatus defined in claim 25 wherein said electronic control circuitry controls said first and second valves to cause said engine to operate in four-cycle positive power mode when said sensor calls for positive power mode and to cause said engine to operate in two-cycle compression release engine braking mode when said sensor calls for compression release engine braking mode.

27. The apparatus defined in claim 24 wherein one of said hydraulic linkages further includes:

a hydraulic fluid diverter valve disposed in the hydraulic fluid coupling of said one of said hydraulic linkages between the master and slave pistons of said one of said hydraulic linkages for selectively diverting, to an interconnection port of said diverter valve, hydraulic fluid flow in that hydraulic fluid coupling that would otherwise flow from that master piston to that slave piston; and a hydraulic fluid cross connection between said interconnection port and the other of said hydraulic linkages for allowing hydraulic fluid flow from said interconnection port to reciprocate the slave piston of said other hydraulic linkage.

28. The apparatus defined in claim 27 wherein said diverter valve is electrically controlled by said electronic control circuitry.

29. The apparatus defined in claim 27 wherein said one of said hydraulic linkages is said first hydraulic linkage, wherein said diverter valve is a first of such diverter valves, wherein said hydraulic fluid cross connection is a first of such cross connections, wherein said other of said hydraulic linkages is said second hydraulic linkage, and wherein said second hydraulic linkage further includes:

a second hydraulic diverter valve disposed in said second hydraulic fluid coupling between said second master piston and said second slave piston for selectively diverting, to an interconnection port of said second diverter valve, hydraulic fluid flow in said second hydraulic fluid coupling that would otherwise flow from said second master piston to said second slave piston; and a second hydraulic fluid cross connection between said interconnection port of said second diverter valve and said first hydraulic linkage for allowing hydraulic fluid flow from said interconnection port of said second diverter valve to reciprocate said first slave piston.

30. The apparatus defined in claim 29 wherein said second diverter valve is electrically controlled by said electronic control circuitry.

31. The apparatus defined in claim 29 wherein said first cross connection hydraulically communicates with said second hydraulic fluid coupling between said second diverter valve and said second master piston, and wherein said second cross connection hydraulically communicates with said first hydraulic fluid coupling between said first diverter valve and said first master piston.

32. The apparatus defined in claim 27 wherein said electrically controlled valve of said one of said hydraulic linkages is hydraulically connected to selectively release hydraulic fluid from the hydraulic fluid coupling of that hydraulic linkage between the diverter valve and the master piston of that hydraulic linkage.

* * * * *